US007725990B2

(12) United States Patent
Patzold

(10) Patent No.: US 7,725,990 B2
(45) Date of Patent: Jun. 1, 2010

(54) HINGE REINFORCEMENT FOR A MOTOR VEHICLE DOOR HINGE

(75) Inventor: Matthias Patzold, Creteil Cedex (FR)

(73) Assignee: Valeo Sicherheitssysteme GmbH, Erdweg (DE)

( * ) Notice: Subject to any disclaimer, the term of this patent is extended or adjusted under 35 U.S.C. 154(b) by 590 days.

(21) Appl. No.: 11/662,123

(22) PCT Filed: Sep. 6, 2005

(86) PCT No.: PCT/EP2005/054377

§ 371 (c)(1),
(2), (4) Date: Mar. 7, 2007

(87) PCT Pub. No.: WO2006/027351

PCT Pub. Date: Mar. 16, 2006

(65) Prior Publication Data

US 2008/0087780 A1 Apr. 17, 2008

(30) Foreign Application Priority Data

Sep. 9, 2004 (DE) ..... 10 2004 043 561

(51) Int. Cl.
*E05D 5/06* (2006.01)

(52) U.S. Cl. ..... 16/387; 16/389; 296/146.11

(58) Field of Classification Search ..... 16/387, 16/389, 390, 380; 296/146.11, 146.12, 202
See application file for complete search history.

(56) References Cited

U.S. PATENT DOCUMENTS 1,363,370 A 12/1920 Soss
3,663,987 A * 5/1972 Hawkins ..... 16/387
4,630,333 A * 12/1986 Vickers ..... 16/338
5,075,927 A * 12/1991 Porta ..... 16/273
5,406,678 A * 4/1995 Kaden et al. ..... 16/342
5,452,847 A * 9/1995 Harris et al. ..... 229/125.11
5,509,175 A * 4/1996 Baughan et al. ..... 16/332
5,611,114 A * 3/1997 Wood et al. ..... 16/366

(Continued)

FOREIGN PATENT DOCUMENTS

JP 06-344774 12/1994

(Continued)

OTHER PUBLICATIONS

Patent Abstracts of Japan, Publication No. 06-344774 dated Dec. 20, 1994 (1 page).

(Continued)

*Primary Examiner*—Chuck Y. Mah
(74) *Attorney, Agent, or Firm*—Osha • Liang LLP

(57) ABSTRACT

Hinge reinforcement (10), for a motor vehicle door hinge, has a shape corresponding to the shape of the hinge bracket (6) and is able to be joined to the hinge bracket. The first end (11) of the reinforcement (10) facing the hinge pin (5) is provided with a fork-like shape so that it can be placed against the hinge pin (5) from below the bracket onto the hinge pin between the bearing arms (9) of the bracket, and on its side facing the bracket a cam (12) engages a recess (13) of the hinge bracket (6) to prevent the hinge reinforcement (10) from falling out. The second end (14) of the reinforcement is connected to the hinge bracket (6) by a fastening element.

8 Claims, 1 Drawing Sheet

U.S. PATENT DOCUMENTS

| | | | | |
|---|---|---|---|---|
| 6,367,863 | B1 * | 4/2002 | Cho | 296/146.11 |
| 6,511,120 | B1 * | 1/2003 | Mitts | 296/202 |
| 6,804,859 | B2 * | 10/2004 | Lu et al. | 16/342 |
| 6,836,933 | B2 * | 1/2005 | Janczak et al. | 16/221 |
| 7,036,187 | B2 * | 5/2006 | Rude | 16/342 |
| 2004/0111833 | A1 | 6/2004 | Janczak et al. | |

FOREIGN PATENT DOCUMENTS

| | | |
|---|---|---|
| JP | 10-203170 | 8/1998 |

OTHER PUBLICATIONS

Patent Abstracts of Japan, Publication No. 10-203170 dated Aug. 4, 1998 (1 page).

International Search Report issued in International Application No. PCT/EP2005/054377 mailed Nov. 21, 2005 (3 pages).

* cited by examiner

Fig.1
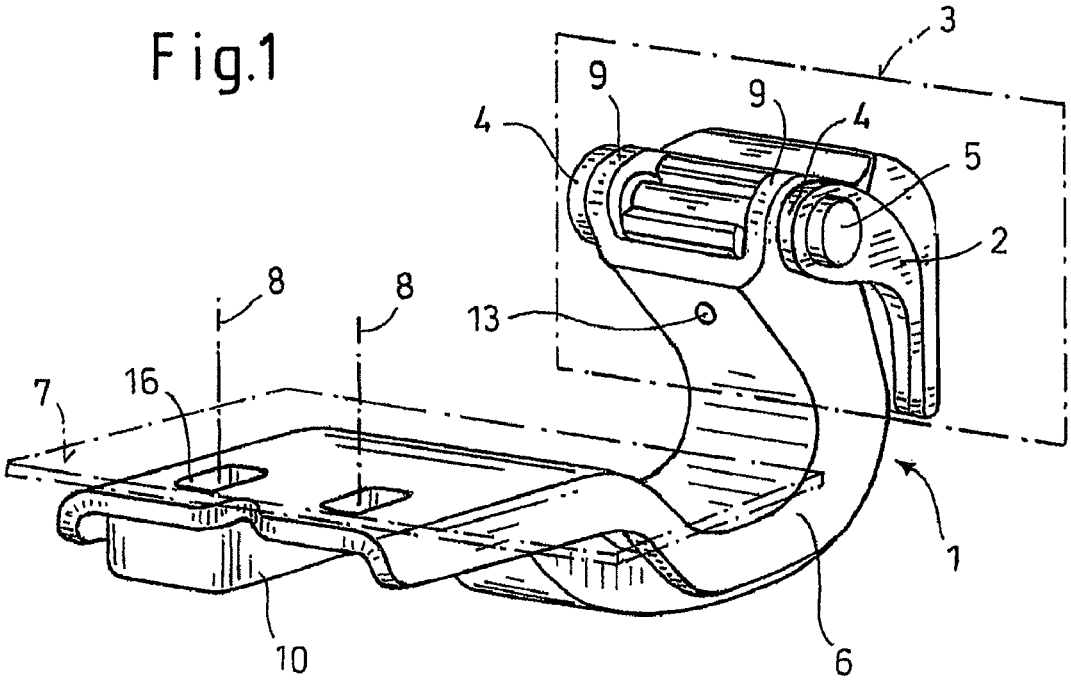
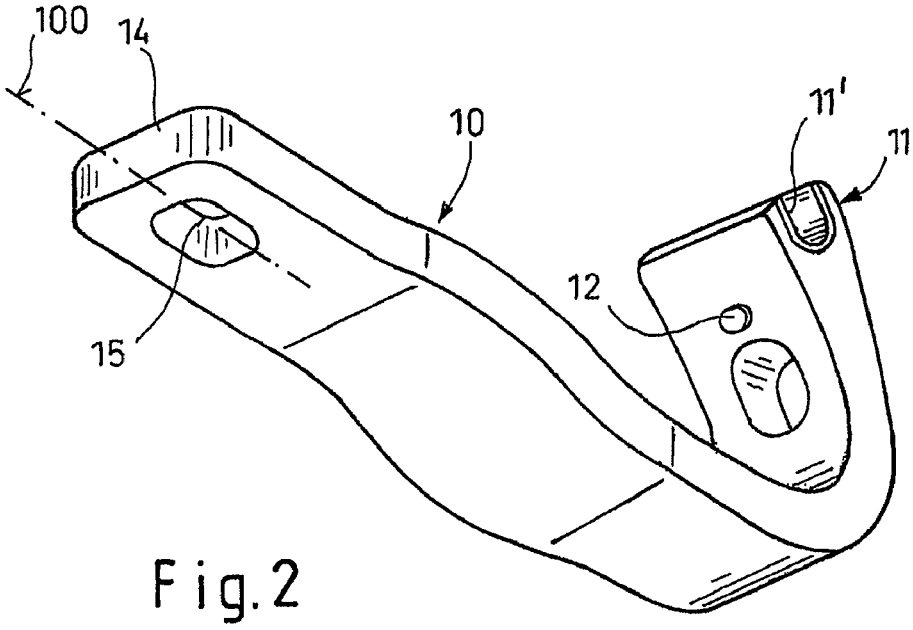
Fig.2

HINGE REINFORCEMENT FOR A MOTOR VEHICLE DOOR HINGE

FIELD OF THE INVENTION

The invention relates to a hinge reinforcement for a motor vehicle door hinge, in particular for pivotably fastening a tailgate, in which are provided a fastening device, which supports the hinge pin and can be connected to the body of the corresponding motor vehicle, and a hinge bracket which can be connected to the vehicle door, with the hinge bracket having, on its side facing toward the hinge pin, two bearing arms which are pivotable about the hinge pin and are spaced apart from one another.

BACKGROUND OF THE INVENTION

In particular in motor vehicles having a drive, which is fastened to the tailgate, for automatically actuating the tailgate, it is necessary for the hinges to withstand higher loads than comparable standard hinges for tailgates without drives of said type. It has therefore already been proposed to replace the conventional standard hinges with higher-strength forged hinges or with hinges with larger cross sections.

A disadvantage of solutions of said type is inter alia that they require relatively expensive measures. In addition, said hinges must, on account of their installation size and the possible different outward-rotating behaviors, be taken into consideration already during the development of the vehicle.

It is already known from JP 06344774 A and JP 10203170 A to provide stiffening in the region of the hinge fastening to the body in order to withstand higher loads of tailgate hinges. Said measures must likewise be taken into consideration already during the assembly of the body.

SUMMARY OF THE INVENTION

The invention is based on the object of disclosing a hinge reinforcement which makes it possible for cost-effective standard hinges to be used even for automatically actuated vehicle doors without expensive measures having to be provided on the vehicle body for this purpose.

Said object is achieved according to the invention by the features of claim 1. Further, particularly advantageous embodiments of the invention are disclosed in the subclaims.

The invention is based substantially on the concept of designing the hinge reinforcement in such a way that it has, at least in partial regions, a form corresponding to the bracket-shaped form of the hinge bracket, and can be connected in a form-fitting manner to the hinge bracket in said regions. Here, that end of the hinge reinforcement which faces toward the hinge pin is of fork-shaped design, in such a way that the first end can be plugged from below onto the hinge pin between the bearing arms of the hinge bracket and is supported on said hinge pin. In addition, the hinge reinforcement supports, on its side facing toward the hinge bracket, and in the region of the hinge pin, a cam which engages in a form-fitting manner from above into a recess of the hinge bracket in such a way as to prevent the hinge reinforcement from falling out and pre-positioning the latter. The fastening of the hinge reinforcement to the hinge bracket and the introduction of force into the hinge reinforcement takes place by means of a fastening screw which connects the respective hinge to the vehicle door.

The hinge reinforcement according to the invention can be plugged onto the hinge pin before or after the assembly of the vehicle door with the hinge, without modifications or dismounting of the hinge being necessary for this purpose. In addition, the installation space and rotational angle need not be restricted. It is necessary only for the hinge bracket to have a bore into which the cam of the hinge reinforcement engages when used as intended.

BRIEF DESCRIPTION OF THE DRAWINGS

Further details and advantages of the invention can be gathered from the following exemplary embodiments which are explained on the basis of figures, in which:

FIG. 1 shows a perspective view of a tailgate hinge, as is known per se, having a hinge reinforcement according to the invention fastened thereto;

FIG. 2 shows a perspective view of the hinge reinforcement illustrated in FIG. 1.

DETAILED DESCRIPTION

In FIG. 1, an outward-rotating tailgate hinge, as is known per se (standard hinge), for a motor vehicle is denoted by 1. The tailgate hinge 1 comprises a fastening device 2 for connecting the hinge 1 to the body 3 (indicated by dashed lines) of the vehicle. The fastening device 2 has two bearing arms 4 which support a hinge pin 5. In addition, the tailgate hinge 1 has a hinge bracket 6 which is pivotable about the hinge pin 5 and to which a tailgate 7 (likewise only indicated by dashed lines), which supports the drive (not illustrated) for actuating the tailgate, is connected by means of two fastening screws 8 (indicated as dash-dotted lines). The hinge bracket 6 supports, on its side facing toward the hinge pin 5, two bearing arms 9 which surround the hinge pin 5.

According to the invention, a steel hinge reinforcement 10 is provided below the hinge bracket 6, which hinge reinforcement 10, despite being of narrower design than the hinge bracket 6, however has, in the direction of its longitudinal axis 100, a bracket-shaped form which corresponds to the hinge bracket 6. In this way, the hinge reinforcement 10, when used as intended, bears in a form-fitting manner against the hinge bracket 6 at least in partial regions. In addition, the hinge reinforcement 10 is of fork-shaped design at its first end 11, which faces toward the hinge pin 5, in such a way that the first end 11 can be plugged from below onto the hinge pin 5 between the bearing arms 9 of the hinge bracket 6 and is supported on said hinge pin 5. The fork-shaped end 11, which is embodied as a bearing, is preferably lined with a Teflon-coated tinplate part 11'.

In addition, the hinge reinforcement 10 supports, on its side facing toward the hinge bracket 6, and in the upper curved region, a cam 12 which engages in a form-fitting manner from above into a corresponding recess 13 of the hinge bracket 6, so as to prevent the hinge reinforcement 10 from falling out and pre-positioning the latter, when the hinge reinforcement 10 is pivoted about the hinge pin 5 toward the hinge bracket 6 after having been plugged onto the hinge pin 5.

The hinge reinforcement 10 is connected at its second end 14, which faces away from the hinge pin 5, to the hinge bracket 6 by means of one of the two fastening screws 8 and has an opening 15, which is aligned with a corresponding opening 16 of the hinge bracket 6, for passing through the fastening screw 8. Since only one of the two fastening screws 8 must be connected to the hinge reinforcement 10, the assembly of the hinge reinforcement does not have any influence on the previously aligned tailgate.

The invention is of course not restricted to the above-described exemplary embodiment. The hinge reinforcement can for example also have a width which corresponds approximately to the width of the hinge bracket. In addition, a light metal or a light metal alloy can also be used as the material for the hinge reinforcement.

REFERENCE SYMBOLS

1 Motor vehicle door hinge, tailgate hinge, hinge
2 Fastening device
3 Body
4 Bearing arm
5 Hinge pin
6 Hinge bracket
7 Vehicle door, tailgate
8 Fastening screw, fastening element
9 Bearing arm
10 Hinge reinforcement
11 (First) end
11' Tinplate part
12 Cam
13 Recess
14 (Second) end
15, 16 Openings
100 Longitudinal axis

The invention claimed is:

1. A hinge reinforcement for a motor vehicle door hinge in which are provided a fastening device, which supports the hinge pin and can be connected to the body of the corresponding motor vehicle, and a hinge bracket configured to be connected to the vehicle door, with the hinge bracket having, on a side facing toward the hinge pin, two bearing arms which are pivotable about the hinge pin and are spaced apart from one another, wherein:

a) the hinge reinforcement is configured to be fastened to the hinge bracket and has a bracket-shaped form which corresponds to the hinge bracket;

b) the hinge reinforcement is of fork-shaped design at a first end, such that the first end is configured to be plugged from below the hinge bracket onto the hinge pin between the bearing arms of the hinge bracket and is supported on said hinge pin;

c) the hinge reinforcement has on a side adapted to face toward the hinge bracket, and in the region of first end, a cam which is configured to engage in a form-fitting manner from above the hinge reinforcement into a recess of the hinge bracket to prevent the hinge reinforcement from falling out and simultaneously pre-positioning the latter, and d) the hinge has connection means which is configured to connect at a second end to the hinge bracket using a fastening element.

2. The hinge reinforcement as claimed in claim 1, wherein the hinge reinforcement is composed of one selected from a group consisting of steel, a light metal, and a light metal alloy.

3. The hinge reinforcement as claimed in claim 2, wherein the fastening element, by means of which the hinge reinforcement can be fastened to the hinge bracket, simultaneously serves as one of the fastening elements for fastening the vehicle door to the hinge bracket.

4. The hinge reinforcement according to claim 2, wherein the fork-shaped end, which is embodied as a bearing, of the hinge reinforcement is lined with a Teflon-coated tinplate part.

5. The hinge reinforcement as claimed in claim 1, wherein the fastening element, by means of which the hinge reinforcement can be fastened to the hinge bracket, simultaneously serves as one of the fastening elements for fastening the vehicle door to the hinge bracket.

6. The hinge reinforcement according to claim 5, wherein the fork-shaped end, which is embodied as a bearing, of the hinge reinforcement is lined with a Teflon-coated tinplate part.

7. The hinge reinforcement according to claim 1, wherein the fork-shaped end, which is embodied as a bearing, of the hinge reinforcement is lined with a Teflon-coated tinplate part.

8. The hinge reinforcement according to claim 1, wherein the hinge reinforcement is for pivotably fastening a vehicle tailgate.

* * * * *